US005649661A

United States Patent [19]

Masuno et al.

[11] Patent Number: 5,649,661

[45] Date of Patent: Jul. 22, 1997

[54] EQUIPMENT FOR NAILING MACHINE

[75] Inventors: Takayuki Masuno; Kazuhiko Mashimo, both of Tokyo, Japan

[73] Assignee: Max Co., Ltd., Tokyo, Japan

[21] Appl. No.: 622,268

[22] Filed: Mar. 27, 1996

[30] Foreign Application Priority Data

Mar. 28, 1995 [JP] Japan ..... 7-094339
Mar. 28, 1995 [JP] Japan ..... 7-094340

[51] Int. Cl.[6] ..... B25C 7/00

[52] U.S. Cl. ..... 227/8; 227/156

[58] Field of Search ..... 227/8, 142, 156

[56] References Cited

U.S. PATENT DOCUMENTS

| | | | |
|---|---|---|---|
| 4,211,353 | 7/1980 | Aunis | 227/156 |
| 4,523,646 | 6/1985 | Doyle et al. | 227/8 |
| 5,131,579 | 7/1992 | Okushima et al. | 227/8 |
| 5,197,646 | 3/1993 | Nikolich | 227/8 |
| 5,238,167 | 8/1993 | Howard et al. | 227/8 |
| 5,261,587 | 11/1993 | Robinson | 227/8 |
| 5,263,626 | 11/1993 | Howard et al. | 227/8 |
| 5,452,835 | 9/1995 | Shkolnikov | 227/8 |
| 5,484,094 | 1/1996 | Gupta | 227/8 |

FOREIGN PATENT DOCUMENTS 2011890 7/1973 Germany .

*Primary Examiner*—Scott A. Smith
*Assistant Examiner*—Jay A. Stelacone
*Attorney, Agent, or Firm*—Cushman Darby & Cushman IP Group of Pillsbury Madison & Sutro, LLP

[57] ABSTRACT

A nailing machine has a contact foot coupled to the front end portion of an contact arm which is provided along a nose section adapted to hammer a nail, such that the contact arm is slidable in a nail hammering direction. The contact foot mounting structure comprises: a U-shaped mounting pin having a pair of legs, a holding piece formed at the front end of the contact arm in which the contact foot is accommodated and held, the holding piece having a pair of inserting sections, into which respective legs of the mounting pin are inserted; and a pair of engaging sections formed at the contact foot, the engaging sections being engaging with respective legs of the mounting pin.

4 Claims, 4 Drawing Sheets

EQUIPMENT FOR NAILING MACHINE

BACKGROUND OF THE INVENTION

1. Field of Invention

This invention relates to a equipment for a nailing machine. More specifically, the invention relates to a contact foot at the end of a contact arm which forms a safety device of a nailing machine, and a gage for a nailing machine which is used to successively secure roofing materials to the roof base materials.

2. Description of Related Art

In general, a nailing machine has a contact arm which detects whether or not a material such as a piece of board to be nailed (hereinafter referred to merely as "material", when applicable) is located at the end of its nail hammering nose section so that its start trigger lever may be effectively pulled only when the material is provided at the end of the nail hammering nose section. The contact arm is coupled to the nailing machine body in such a manner that it is slidable with respect to the nail hammering direction. The front end of the contact arm protrudes more than the end of the nose section, and the other end confronts with the trigger lever. When, with the front end of the contact arm pushed against the surface of the material, the other end is engaged with the trigger lever, the pulling of the trigger is made effective. A contact foot is detachably coupled to the front end portion of the contact arm.

During use of a roofing nailer for nailing roofing materials, the latter may stick onto the front end portion of the nose section, thus making the nailer out of order. Hence, the front end portion must be cleaned frequently. This cleaning operation is carried out with the contact foot removed from the front end portion of the contact arm.

However, this cleaning operation is rather troublesome. That is, in the conventional roofing nailer, the contact foot is fixedly secured to the contact arm with a hexagon socket head cap screw. Therefore, the contact foot and the contact arm cannot be engaged with or disengaged from each other without use of a tool such as a hexagonal wrench. In addition, it is necessary to tap the bolt to form a threaded hole, which increases the manufacturing cost as much.

In general, a roof structure is such that roofing materials such as roofing tiles are laid over the roofing base material in such a manner that they are overlapped with one another, and are then nailed to the roof base material with a single gage provided under the nailing machine. That is, with the single gage engaged with the end face of the roofing material, the nail ejecting section of the nailing machine is set at a predetermined position at all times.

The gage is liable to be worn out because, whenever a nail is hammered with the nailing machine to secure a roofing material, the gage must be abutted against the roofing material. Hence, the gage is so designed as to be replaced with a new one, if necessary. That is, in a conventional gage mounting structure, as disclosed by Japanese Utility Model Application Laid-open No. Hei. 5-376, a rail is fixedly set on the bottom of a nail magazine in which a series of nails coupled to one another are accommodated, and the gage is fixed to the rail through a bolt, nut, screw, metal member, operating member, etc.

However, the above-described gage mounting structure is disadvantageous in the following points: That is, it is relatively large in the number of components, and its assembling work takes time and labor, and accordingly it is relatively high in manufacturing cost.

SUMMARY OF THE INVENTION

In view of the foregoing, an object of the invention is to provide a contact foot mounting structure which permits the contact foot to engage with or disengage from the contact arm with ease, and is low in manufacturing cost.

Another object of the invention is to eliminate the above-described difficulties accompanying a conventional gage mounting structure for a nailing machine. More specifically, an object of the invention is to provide a gage mounting structure for a nailing machine which is relatively small in the number of components, and can be assembled with high efficiency.

According to a first aspect of the invention, there is provided a contact foot mounting structure for a nailing machine in which a contact foot is coupled to the front end portion of an contact arm which is provided along a nose section adapted to hammer a nail, such that the contact arm is slidable in a nail hammering direction, the contact foot mounting structure comprising: a U-shaped mounting pin having a pair of legs; a holding piece formed at the front end of the contact arm in which the contact foot is accommodated and held, the holding piece having a pair of inserting sections, into which respective legs of the mounting pin are inserted; and a pair of engaging sections formed at the contact foot, the engaging sections being engaging with respective legs of the mounting pin.

According to a second aspect of the invention, there is provided a gage mounting structure for a nailing machine including a nailing machine body having a nail ejecting section, and a magazine which accommodates a series of nails which are to be supplied to the nail ejecting section, the gage mounting structure comprising: a rail formed on the bottom of the magazine and extending in a front-to-rear direction perpendicular to a nail hammering direction, the rail having an adjusting through-hole is elongated longitudinally of the rail; a gage slidably mounted on the rail, the gage having a pair of clamping pieces adapted to hold the rail from both sides; a mounting bolt inserted through one of the clamping pieces of the gage into the adjusting through-hole of the rail, and protruding from the other clamping piece; and a nut fixedly securing the gage with mounting bolt.

With the contact foot mounting structure of the invention, the contact foot can be coupled to the plate-shaped portion of the contact arm. That is, after the contact foot is fitted inside the holding piece of the contact arm, the legs of the mounting pin are inserted into the inserting sections, and engaged with the engaging sections of the contact foot.

In the case where it is required to wash the contact foot, it can be readily removed from the contact arm 1 with a flat tip screwdriver being twisted between the contact arm and the mounting pin.

With the gage mounting structure of the invention, the gage can be mounted as follows: The bolt is inserted through one of the clamping pieces of the gage into the adjusting through-hole of the rail, and protruded from the other clamping piece, and fixedly secured with a nut.

DETAILED DESCRIPTION OF THE PREFERRED EMBODIMENTS

Figure 1:
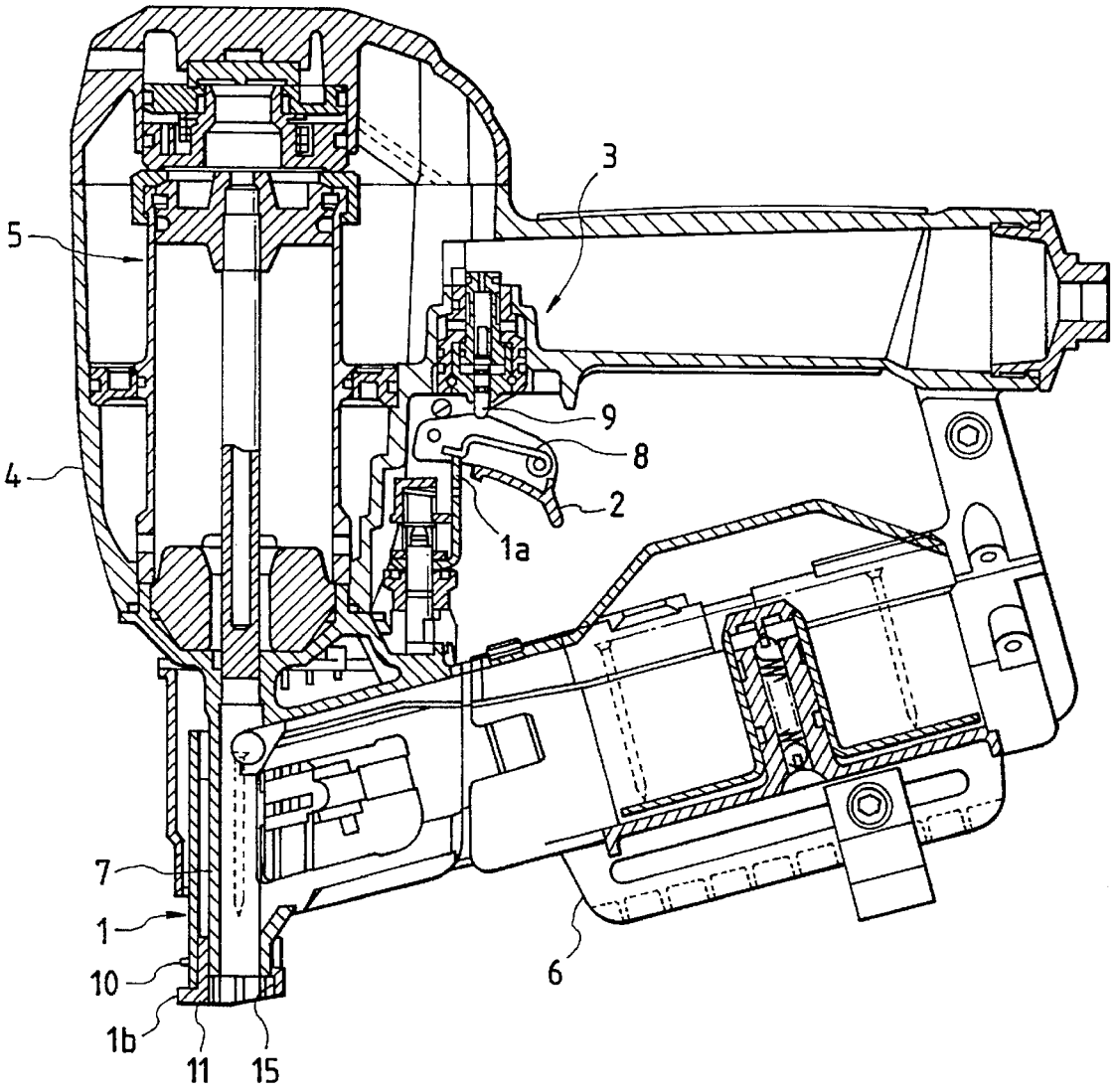
FIG. 1 is an arrangement of a nailing machine according to the invention.

FIG. 1 shows a nailing machine, which employs a compressed air drive source. While a contact arm 1 is being pushed against a material to be nailed (not shown), a trigger lever 2 is operated to activate a trigger valve 3 thereby to drive a hammering mechanism 5 inside the machine body 4, so that a nail supplied to a nail ejecting nose section 7 from a magazine 6 is hammered.

The contact arm 1 is slidably coupled to the machine body 4 in such a manner that it is slidable in the nail hammering direction, and its base end portion 1*a* confronts with the trigger lever 2, and its front end portion 1*b* protrudes from the end of the nose section 7. As the front end portion 1*b* of the machine body 1 is pushed against the material to be nailed (hereinafter referred to as "a material", when applicable), the contact arm 1 is moved upwardly in FIG. 1, so that the base end portion pivots an operating piece 8 which is pivotably coupled to the trigger lever 2. When, under this condition, the trigger lever 2 is pulled, the operating piece 8 pushes the valve stem 9 of the trigger valve 3, so that the nailing machine starts its operation. On the other hand, in the case where the trigger lever 2 is pulled with the contact arm 1 not pushed, the operating piece 8 does not push the valve stem 9, and therefore the nailing machine does not work.

Figure 3:
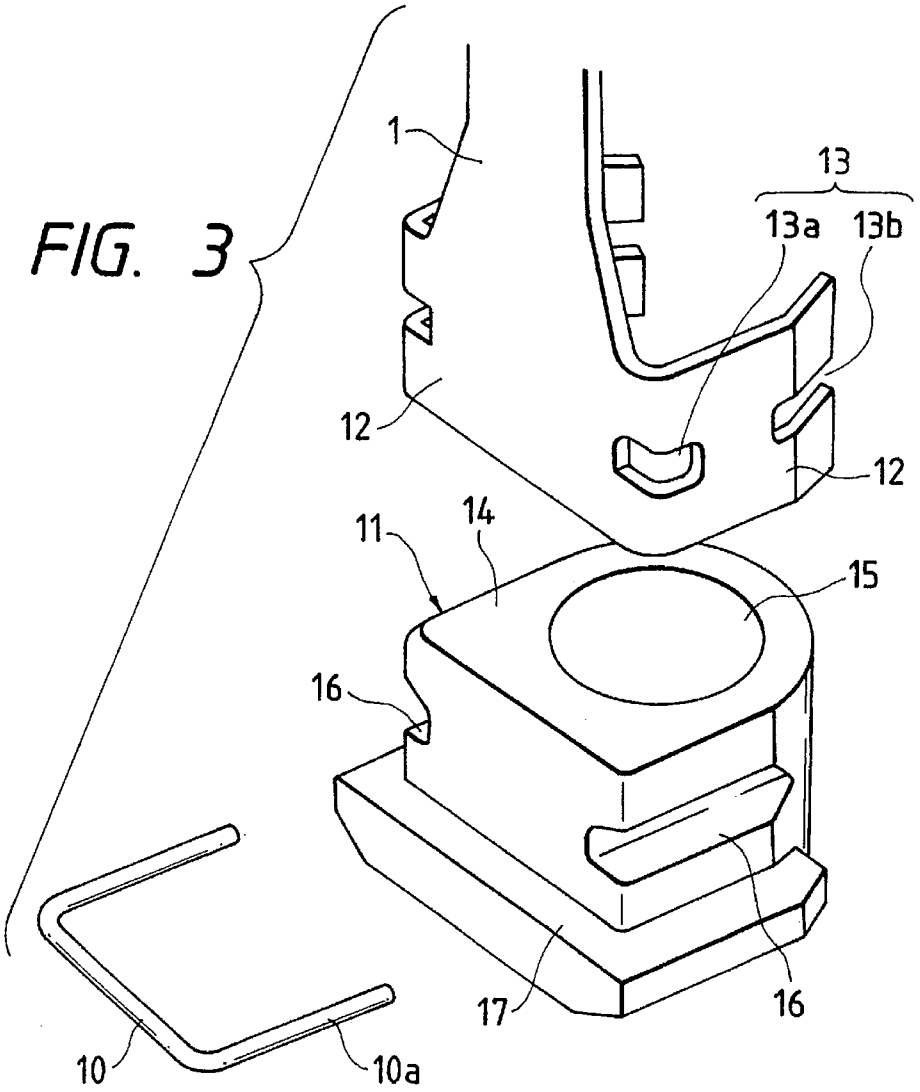
FIG. 3 is an exploded perspective view of the front end portion of the contact arm.
Figure 2:
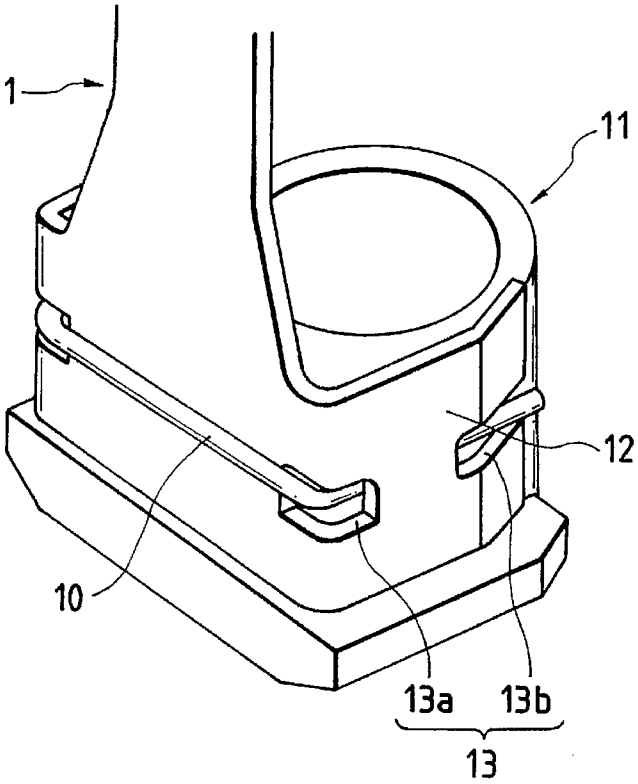
FIG. 2 is a perspective view of the front end portion a contact arm in the nailing machine.

On the other hand, the front end portion of the nose section 7 of the contact arm 1 is in the form of a plate arranged along the side of the nose section as shown in FIGS. 2 and 3. A contact foot 11 is coupled to the front end portion by using a U-shaped mounting pin 10.

In other words, the front end portion of the contact arm 1 includes a holding piece 12 which is adapted to accommodate the contact foot 11 inside it. The holding piece 12 has a pair of right and left end portions which are inwardly and obliquely (not at right angles) bent. Each of the end portions thus bent has a slit 13*b*, and the holding piece 12 has a through-hole 13*a* in its back in such a manner that the through-hole is located behind the slit 13*b*. The slit 13*b* and the through-hole 13*a* form an inserting section 13. Thus, the holding piece 12 of the contact arm has a pair of inserting sections 13. On the other hand, the contact foot 11 has a contact foot body 14 which corresponds in size to the holding piece 12. The contact foot body 14 has a fitting opening 15 at the center which is slidably engaged with the nose section, and a pair of engaging grooves 16 in it both side surfaces. The lower end portion of the contact foot body 14 is formed into a block-shaped member which provides the receiving section 17 adapted to receive (or support) the lower end face of the holding piece.

The front end portion of the contact arm 1 is joined to the contact foot 11 as follows: The contact foot 11 is set inside the holding piece 12 from below, and the nose section 7 is fit with the fitting opening 15. With the lower end face of the plate-shaped portion of the holding piece 12 abutted against the receiving section 17, the legs 10*a* of the mounting pin 10 are inserted into the through-holes 13*a* of the holding piece 12. Under this condition, the legs 10*a*, while being moved along the inner surfaces of the holding piece 12, are inserted into the engaging grooves 16 of the contact foot 11, and into the slits 13*b* at the bent portions of the front end portion of the contact arm 1. Thus, the front end portion of the contact arm 1 is fixedly fastened to the contact foot 11.

It is preferable that the mounting pin 10 is elastic so that the two legs are urged towards each other, and that both end portions of the two legs are bent towards each other so that the pin may not come off by vibrations caused during nailing.

In the case where it is required to wash the contact foot 11, it can be readily removed from the contact arm 1 with a tool such as a flat-tip screwdriver being twisted between the contact arm 1 and the mounting pin 10.

In the holding piece, instead of the slits 13*b*, elongated holes may be employed.

In the above-described embodiment, the engaging sections on both sides of the contact foot 11 are the grooves; however, the latter may be replaced with through-holes into which the legs of he mounting pin are inserted.

Figure 4:
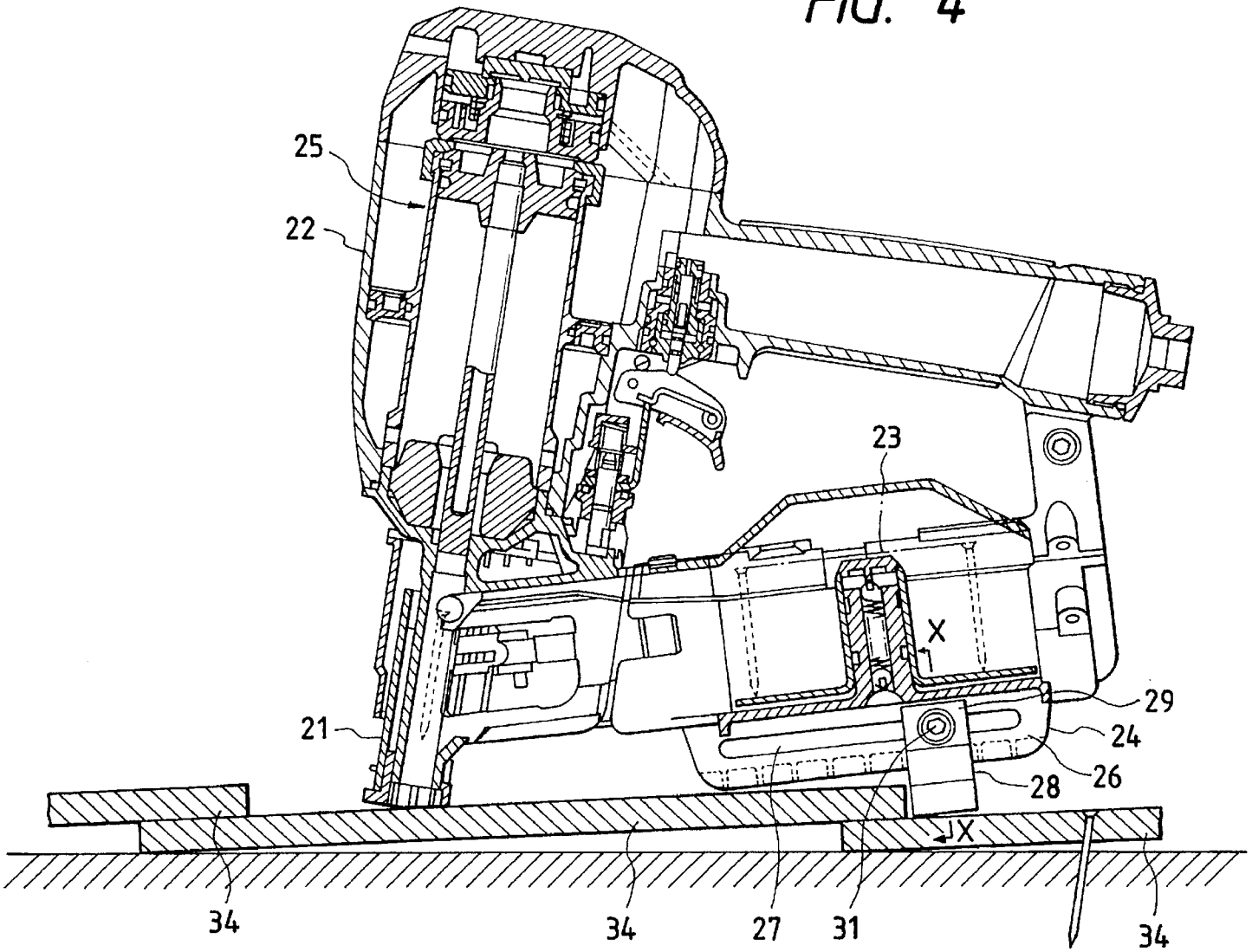
FIG. 4 is another nailing machine according to the invention.

FIG. 4 shows another nailing machine according to the invention. The nailing machine comprises: a nailing machine body 22 having a nail ejecting section 21; and a magazine 24 which accommodates a series of nails 23 coupled, in the form of a belt, to one another so that those nails are supplied to the nail ejecting section 21. Inside the nailing machine body 22, a hammering mechanism 25 is provided to hammer the nail located in the nail ejecting section 21. As was described above, the series of nails 23 are coupled to one another in the form of a belt, and set coiled in the magazine 24. The series of nails 23 are fed into the nail ejecting section through a nail passageway by a nail feeding device (not shown).

Figure 5:
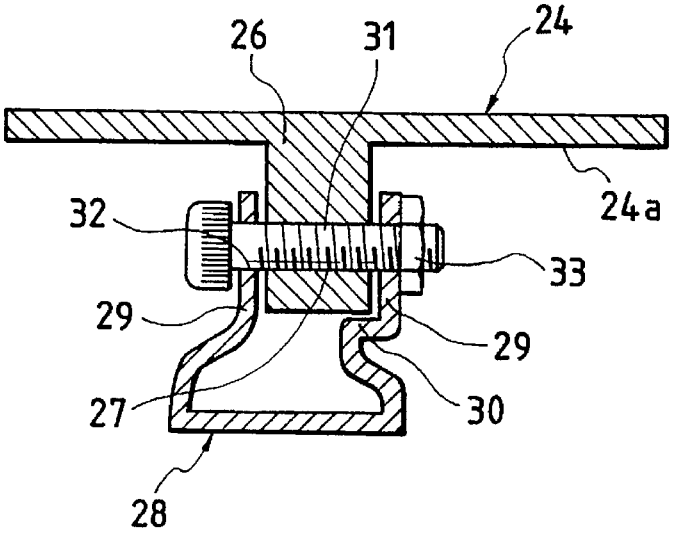
FIG. 5 is a sectional view taken along line X—X in FIG. 4.
Figure 6:
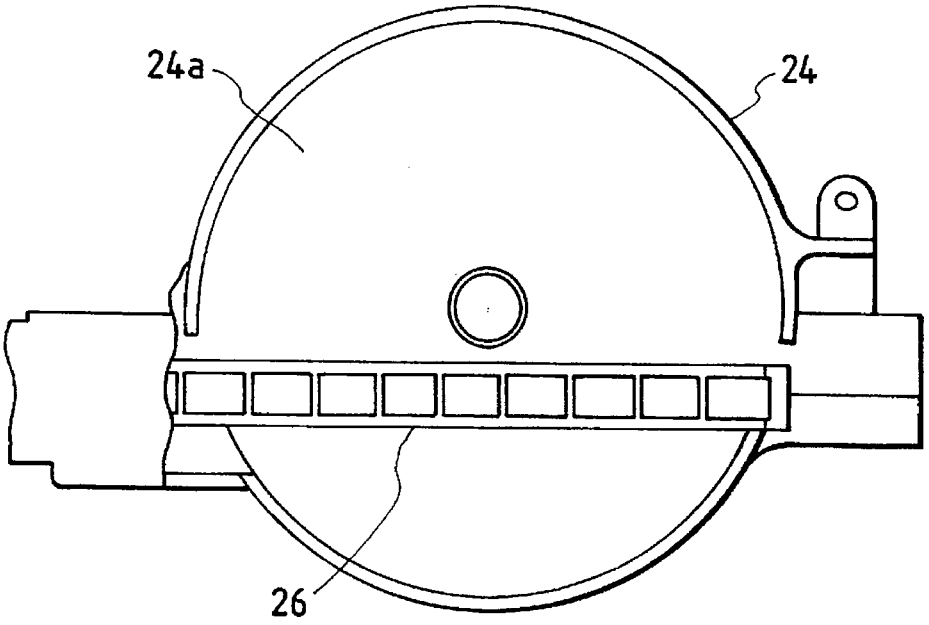
FIG. 6 is a bottom view of the nail magazine of the nailing machine.

The magazine 24 is made of synthetic resin. As shown in FIGS. 5 and 6. A rail 26 protrudes from the bottom 24*a* of the magazine 24 in such a manner that it is slightly off-centered. More specifically, the rail 26 extends in a front-to-rear direction perpendicular to a direction in which a nail is hammered, and has an adjusting through-hole 27 elongated longitudinally of the rail 26.

A gage 28 is slidably mounted on the rail 26. The gage 28 is made of metal or synthetic resin, and is hollow. More specifically, the gage 28 has clamping pieces 29 on its both sides to hold the rail 26 from both sides. One of the clamping pieces 29 is bent near its base end to have a step 30. The step 30 is so shaped that its upper surface is abutted against the lower surface of the rail 26. The clamping pieces 29 of the gage 28 have through-holes 32 into which a mounting bolt 31 is inserted.

The gage 28 is secured to the magazine as follows: The mounting bolt 31 is inserted through the through-hole 32 of one of the clamping pieces 29 of the gage 28 into the adjusting through-hole 27 of the rail 26, and protruded through the through-hole 32 of the other clamping piece 29, and is then fixed with a nut 33. Thus, the gage 28 has been fixedly secured to the rail 26 of the magazine. The gage 28 is used as follows: As shown in FIG. 4, the gage 28 is abutted against the end face of the roofing material 34, to position the nail ejecting section 21. Under this condition, the nailing machine is operated. When a roofing material is to be nailed, the nailing machine is shifted substantially in parallel with the roofing material until the gage 28 is abutted against the end face of the next upper roofing material, and the nailing machine is operated.

The gage 28 can be adjusted in position as follows: With the nut 33 loosened, the bolt 31 is slid along the adjusting through-hole 27 formed in the rail so that the distance between the nail ejecting section 21 and the gage 28 be a desired value. After the bolt has been set in the above-described manner, the nut 33 is tightened to fix the position of the gage 28.

As was described above, one of the clamping pieces 29 of the gage 28 has the step 30 near the base end thereof, and the upper surface of the step 30 is in abutment with the lower surface of the rail 26. This feature eliminates the difficulty that the gage 28 is turned around the mounting bolt 31.

With the contact foot mounting structure, the contact foot can be engaged with or disengaged from the contact arm with the mounting pin only; that is, the engagement and disengagement of the contact foot can be achieved with ease. In addition, the structure itself is simple in design, and is accordingly small in the number of components, which contributes to a reduction in manufacturing cost.

In the gage mounting structure of the invention, the rail is integral with the magazine. This fact provides the following effects or merits: The number of components is reduced as much, the gage mounting work can be achieved readily and quicky, and the manufacturing cost becomes low.

We claim:

1. A contact foot mounting structure for a nailing machine in which a contact foot is coupled to a front end portion of a contact arm which is provided along a nose section of said nailing machine adapted to hammer a nail, such that the contact arm is slidable in a nail hammering direction, said contact foot mounting structure comprising:

a U-shaped mounting pin having a pair of legs;

a holding piece formed at the front end portion of the contact arm in which the contact foot is accommodated and held, said holding piece having a pair of inserting sections, into which respective legs of said mounting pin are inserted; and a pair of engaging sections formed at the contact foot, said engaged sections being engaging with respective legs of said mounting pin.

2. The contact foot mounting structure according to claim 1, wherein said mounting pin is elastic to urge said legs of said mounting pin towards each other, and end portions of said legs are bent towards each other.

3. The contact foot mounting structure according to claim 1, wherein each of said engaging sections comprises a groove.

4. The contact foot mounting structure according to claim 1, wherein each of said engaging sections comprises a through-hole.

* * * * *